US006990697B1

(12) United States Patent
Clute

(10) Patent No.: US 6,990,697 B1
(45) Date of Patent: Jan. 31, 2006

(54) BED RAIL WITH ENTRAPMENT-RESISTANT SIDE PANEL

(76) Inventor: Lorne Jason Clute, 2379 Round Hill Dr., Alamo, CA (US) 94507

( * ) Notice: Subject to any disclaimer, the term of this patent is extended or adjusted under 35 U.S.C. 154(b) by 0 days.

(21) Appl. No.: 10/923,335

(22) Filed: Aug. 20, 2004

(51) Int. Cl.
*A47C 21/08* (2006.01)

(52) U.S. Cl. ..... 5/426; 5/425; 5/663

(58) Field of Classification Search ..... 5/425–430, 5/663

See application file for complete search history.

(56) References Cited

U.S. PATENT DOCUMENTS

| | | | | |
|---|---|---|---|---|
| 3,290,701 | A * | 12/1966 | Luff | 5/426 |
| 3,742,530 | A * | 7/1973 | Clark | 5/482 |
| 4,178,645 | A * | 12/1979 | Cosme | 5/426 |
| 4,370,765 | A * | 2/1983 | Webber | 5/427 |
| 4,724,559 | A * | 2/1988 | Bly et al. | 5/425 |
| 4,827,545 | A * | 5/1989 | Arp | 5/424 |
| 4,993,089 | A | 2/1991 | Solomon et al. | |
| 5,481,772 | A | 1/1996 | Glynn et al. | |
| 5,557,817 | A * | 9/1996 | Haddock | 5/663 |
| 5,671,490 | A | 9/1997 | Wu | |
| D391,792 | S | 3/1998 | Scherer et al. | |
| 5,761,756 | A | 6/1998 | Nowak et al. | |
| 5,987,666 | A | 11/1999 | Zigmont | |
| 6,453,490 | B1 * | 9/2002 | Cardinale | 5/426 |
| 6,725,476 | B2 * | 4/2004 | Macari | 5/426 |
| 2004/0040089 | A1 * | 3/2004 | Flannery et al. | 5/425 |

* cited by examiner

*Primary Examiner*—Michael Trettel
(74) *Attorney, Agent, or Firm*—R. Michael West

(57) ABSTRACT

A bed rail for mounting to the side of a bed includes a pair of support legs and an entrapment-resistant side panel. The side panel includes a rigid frame enclosed within a flexible bed rail cover. The frame is generally rectangular in shape, having upper, intermediate, and lower horizontal rods, spanning first and second vertical shafts. The intermediate rod is preferably attached to the bed rail covering by means of a sheath, and located so as to restrain outward lateral excursions of said bed rail covering in the region between the lower and upper rods. The lowermost ends of the vertical shafts are pivotally connected to outer ends of the support legs. The support legs have inner ends installed between the mattress and the box spring. Anchor straps extend between the outer ends of the support legs and an anchor plate on the other side of the bed.

18 Claims, 3 Drawing Sheets

BED RAIL WITH ENTRAPMENT-RESISTANT SIDE PANEL

BACKGROUND OF THE INVENTION

1. Field of the Invention

The invention relates generally to apparatus designed to prevent patients or children from falling out of beds. More particularly, the invention pertains to a portable bed rail construction, employing a vertical side panel having imbedded rigid structure to resist outward lateral forces imposed by a disabled person or a child.

2. Description of the Prior Art

Bed rails have been used for many years in hospitals and health care facilities to restrain patients, and in particular, to prevent them from falling out of a bed or making other damaging movements. Many of these bed rails are structurally integrated with the bed, and generally include some adjustability feature, so they can be raised and lowered with respect to the bed mattress. A Bed Rail Mechanism, shown in U.S. Pat. No. 4,993,089, granted to Solomon et al., is representative of this type of bed rail.

One problem which has been recognized with bed rails is the gap which exists or which can be formed, between a mattress and a bed rail. In U.S. Pat. No. 5,987,666, a Gap-Filling Pad Disposable Between A Mattress And A Bed Rail is shown. FIG. 1 of the '666 patent illustrates how a patient can become entrapped between a bed rail and a mattress, and possibly suffocate.

It has also been recognized that the structure of bed rails themselves can present dangers to patients. Accordingly, elastomeric bed rail covers have been devised having a flap extending between the cover and the bed, preventing bed occupants from extending arms or legs through the gap between the mattress and the bed rail. Such a bed rail cover is shown in U.S. Pat. No. 5,481,772, issued to Glynn et al.

Smaller bed rails are also popular for use with infant or youth beds. Some of these smaller bed rails are both collapsible and portable. For example, in U.S. Pat. No. 5,671,490, granted to Wu, a Collapsible Bed Rail Structure is shown. Another design for Portable, Foldable Bed Rail is illustrated in Des. No. 391,792, issued to Scherer et al. And, U.S. Pat. No. 5,761,756, granted to Nowak et al., discloses a Portable Bed Rail having first and second foot members, insertable into vertical members of a side panel.

The smaller, collapsible bed rails have their own safety issues. Typically, such bed rails have lower and upper support rods spanning vertical shafts forming a generally rectangular bed rail panel. The bed rail panel is covered with a plastic or fabric panel cover, which may include a mesh insert in its central portion. A potentially dangerous situation may be posed by outward deflection of the flexible panel cover, in the region above the mattress itself. In this region, between the lower and upper rods, the flexible panel cover is largely unsupported, and forces imposed by the patient or small child rolling into the panel may cause it to flex outwardly and create a suffocating pocket. The present invention is directed toward addressing and solving this problem.

SUMMARY OF THE INVENTION

The bed rail of the present invention includes a bed rail frame and a compliant and flexible bed rail covering. The bed rail frame includes bed rail legs sized and configured to fit between a bed box spring and a bed mattress. The rail legs have outer ends extending to one side of the bed, and inner ends extending toward the center region of the bed.

The bed rail frame further includes a generally rectangular side panel frame, oriented so that its elongated axis is horizontal. The side panel frame is hingeably attached at two corners to the rail legs extending between the box spring and the bed mattress. The side panel frame has a normal working position extending vertically, above and normal to the plane of the bed mattress. However, the hinged mounting arrangement also has a lowered locked position, whereby the panel frame may be rotated 180° to extend vertically downwardly, out of the way.

The side panel frame is comprised of a lower rod, an upper rod, and an intermediate rod between the lower and upper rods. All three rods are arranged in parallel, spaced relation. The lower and upper rods have end extremities interconnected to a first vertical shaft and a second vertical shaft extending from the outer ends of the rail legs. In effect, the lower and upper rods form the elongated sides of the rectangular frame, and the vertical shafts form the transverse ends of the frame.

The flexible bed rail covering, made from plastic, vinyl or fabric, is substantially co-extensive with the side panel frame. The covering includes lower, intermediate and upper horizontal sleeves arranged in parallel, spaced relation. The covering also includes a pair of vertical sleeves. These sleeves are sized and configured to accommodate and substantially cover the lower rod, the intermediate rod, the upper rod, and the first and second vertical shafts. Being structurally integrated with the bed rail covering, the intermediate rod is particularly effective to restrain outward lateral excursions of the bed rail covering in the otherwise unsupported region which exists between the lower and upper rods.

DETAILED DESCRIPTION OF THE PREFERRED EMBODIMENT

Figure 1:
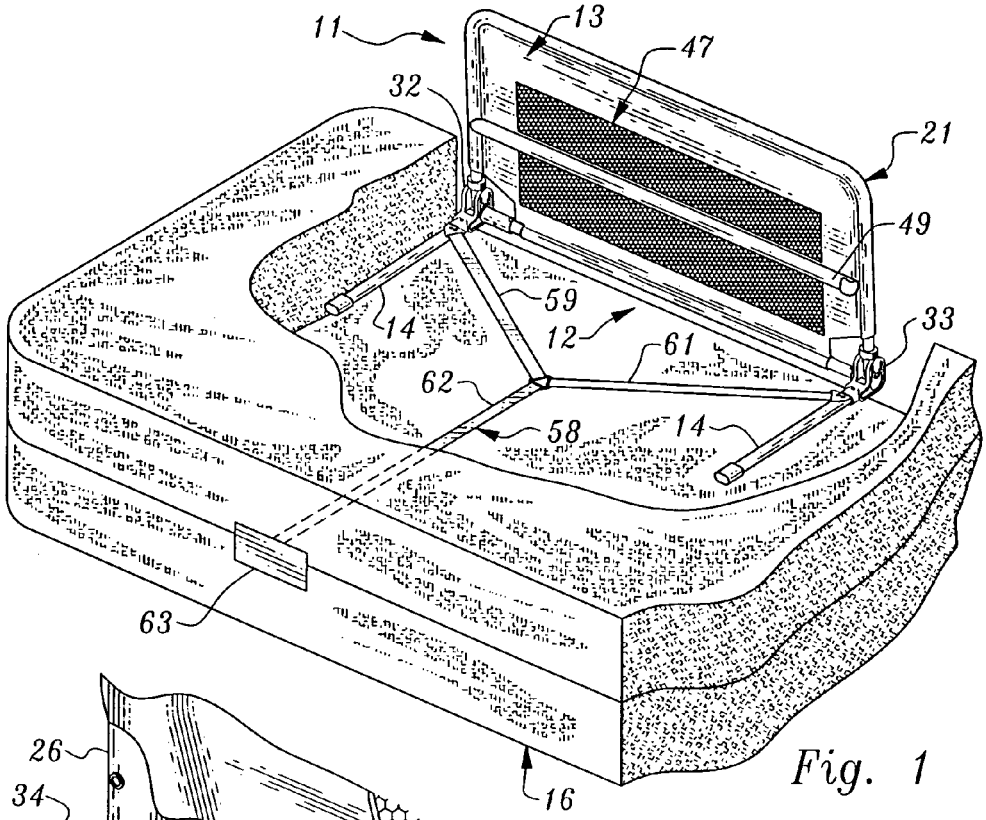
FIG. 1 is a fragmentary, right-front perspective view of a bed and the bed rail of the present invention, portions of the mattress being broken-away to show the support legs and anchor strap.

Turning now to the drawings, and in particular to FIG. 1, the bed rail 11 of the present invention generally comprises a bed rail frame 12 and a bed rail covering 13. Frame 12 includes bed rail legs 14 adapted to fit between a bed box spring 16 and a bed mattress 17. Bed rail legs 14 have an outer end 18 extending to one side of the bed and an inner end 19 extending toward the middle portion of the mattress 17.

Figure 2:
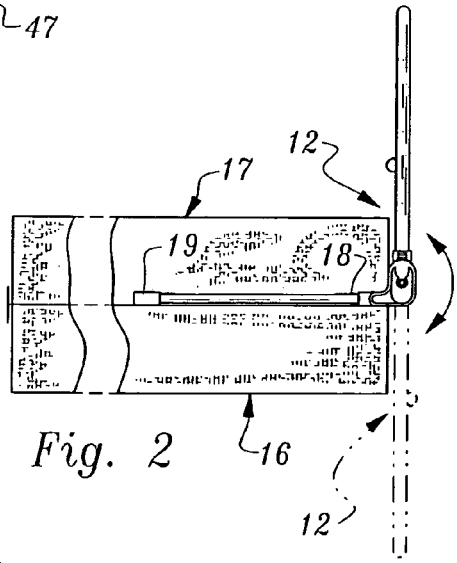
FIG. 2 is an end elevational view, showing the bed rail legs inserted between the box-spring and the mattress, the solid and broken-line representations of the side panel frame and covering respectively illustrating its raised and lowered positions.
Figure 4:
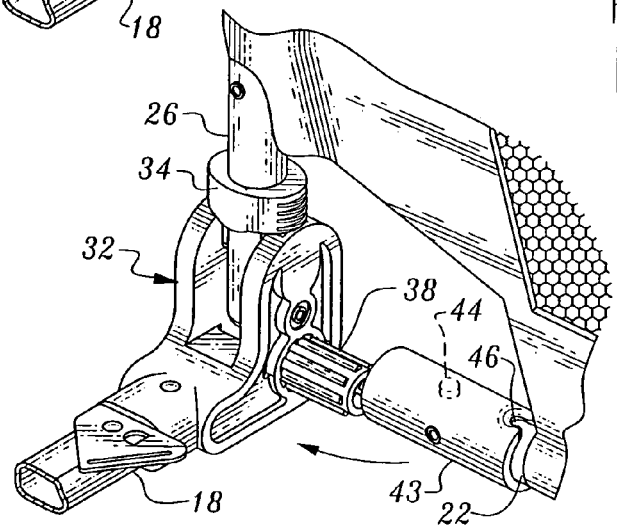
FIG. 4 is a close-up perspective view as in FIG. 3, but with the lower rod in near alignment with the grooved shaft of the corner hinge assembly.

Bed rail frame 12 further includes an elongated side panel frame 21, having a horizontal axis. During normal use, side panel frame 21 extends vertically above bed mattress 17, as shown in FIGS. 1 and 2. However, owing to its pivotal mounting arrangement, to be discussed more fully below, side panel frame 21 may also be rotated downwardly into a lowered position, as shown in broken line in FIG. 2. Side panel frame 21 is comprised of a lower rod 22, an upper rod 23, and an intermediate rod 24 located therebetween.

Figure 10:
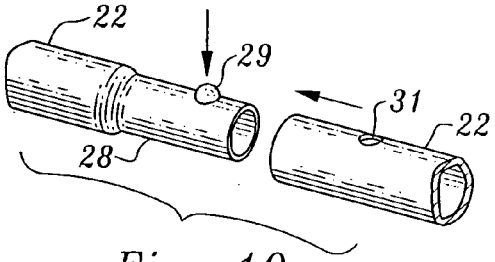
FIG. 10 is a perspective view of the pin detent locking coupler used to join halves of the lower, middle and upper rods.

Preferably, and for ease of assembly and disassembly, each of the rods is comprised of two detachably connected sections. FIG. 10 is representative of the detachable coupling which may be employed, incorporating a swaged end 28 fitted with a spring-loaded pin 29. An aperture 31 is provided in the adjacent end of a section of rod 22. Upon depressing pin 29, swaged end 28 may be inserted into the adjacent rod section, until pin 29 registers with aperture 31 and locks therein. Other well known expedients including pin and groove interlocking elements, rotational friction clamps, or telescoping rods may be used interchangeably to connect the rod sections.

Figure 6:
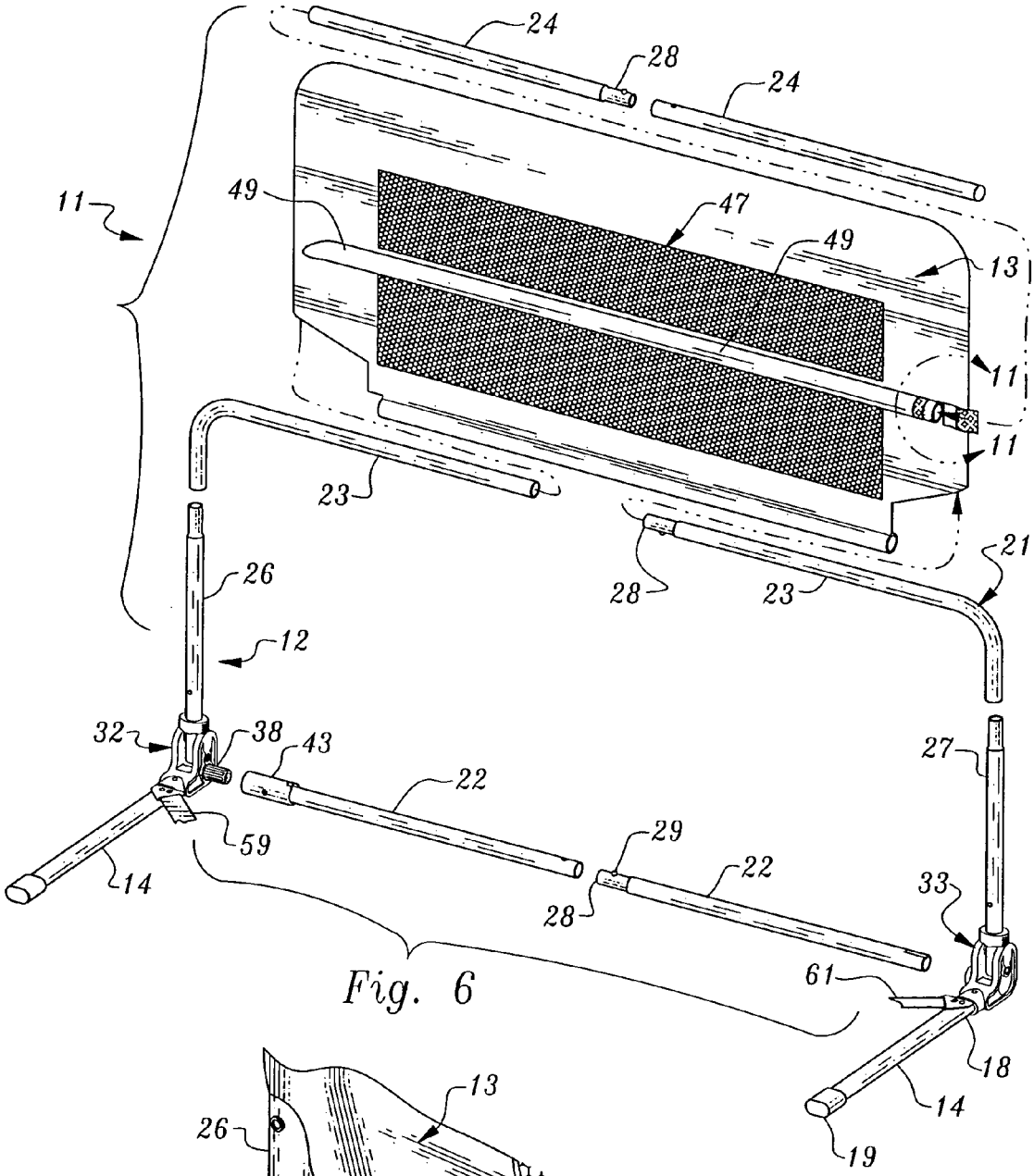
FIG. 6 is an exploded perspective view, showing the manner of assembling the lower and upper rods, and installing the intermediate rod within its sheath.
Figure 5:
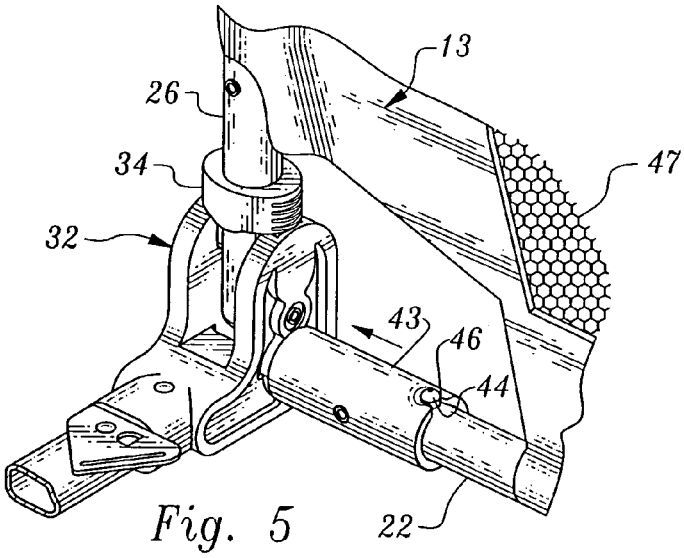
FIG. 5 is a close-up perspective view as in FIG. 4, but showing the coupler released thereby connecting the lower rod to the head corner assembly.

As shown most clearly in FIG. 6, side panel frame 21 also includes a first vertical shaft 26 and to a second vertical shaft 27. Upper end extremities of shafts 26 and 27 are connected to respective ends of upper rod 23. Although the ends of upper rod 23 are curved downwardly, so as to fit over shafts 26 and 27, different arrangements could be employed. For example, the rod and shafts could meet and connect in the corner of the frame 21, or the shafts could be extended and curved around to meet a straight shaft 23.

Figure 7:
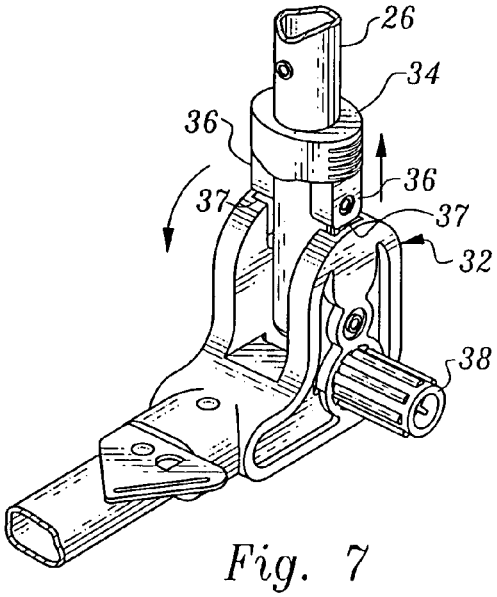
FIG. 7 is a left front perspective of the head corner assembly, with the locking collar lifted free from its receptacle, showing the direction of rotation of the first vertical shaft toward a horizontal position.
Figure 8:
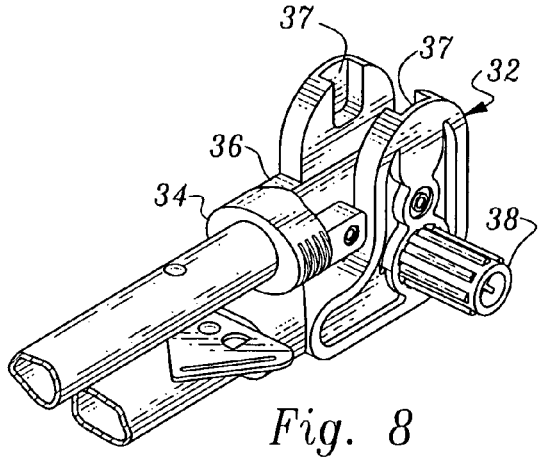
FIG. 8 is a perspective view as in FIG. 7, showing the head corner assembly in a horizontal nested position for storage or transport.

Respective lower end extremities of shafts 26 and 27 are pivotally connected to a head corner assembly 32 and a foot corner assembly 33. Corner assemblies 32 and 33 include a spring-biased retainer collar 34 provided with side bars 36. Collar 34 may be raised vertically (See, FIG. 7), so that side bars 36 are lifted free from apertures 37. This allows shafts 26 and 27 to be rotated forwardly into a compact horizontal position when the bed rail and its components are disassembled for storage or transport (See, FIG. 8). Or, shafts 26 and 27 may be rotated downwardly into a vertical position, when the bed rail frame 12 is out of operating position (See, FIG. 2). However, when bed rail frame 12 is in a normal operating position, side bars 36 nest fully within apertures 37, providing a rigid right-angle interconnection between the frame 12 and the supporting legs 14.

Figure 3:
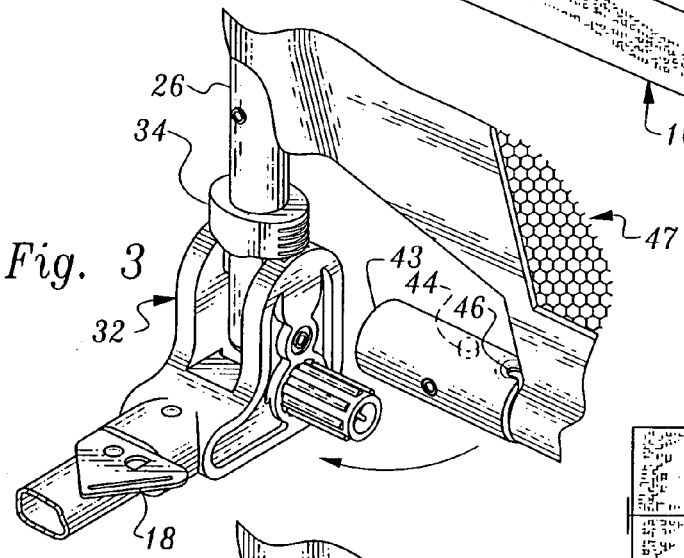
FIG. 3 is a close-up perspective view of a head corner assembly, showing the coupler of the lower rod retracted in preparation for connection to the head corner assembly.
Figure 9:
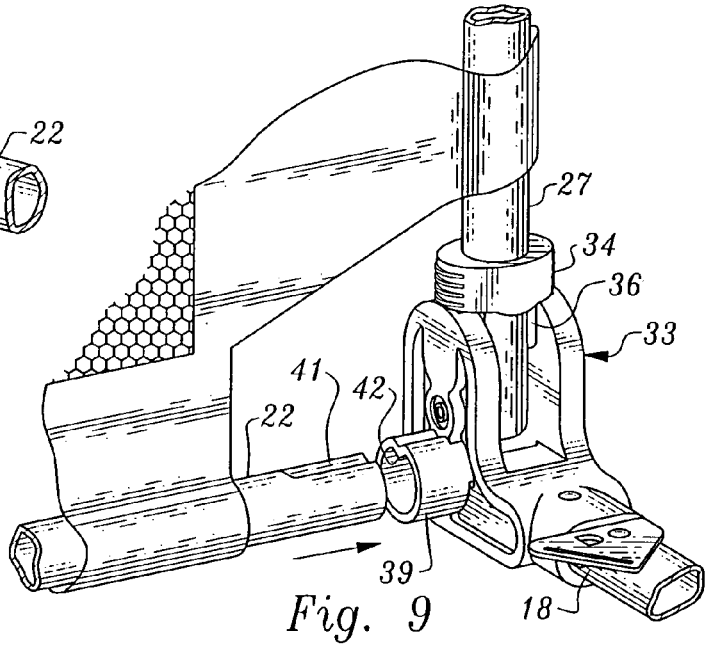
FIG. 9 is a perspective view of the foot corner assembly, showing the other end of the lower rod being translated into engagement with the keyed receiver.
Figure 11:
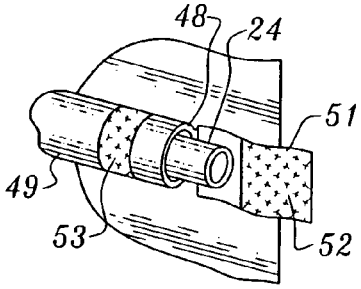
FIG. 11 is a detail inset of one end of the intermediate rod within the sheath.

Corner assemblies 32 and 33 also include means to interconnect with lower rod 22. For that purpose, head corner assembly 32 is provided with a grooved shaft 38, extending inwardly toward foot corner assembly 33. And, foot corner assembly 33 is provided with a keyed receiver 39, directed inwardly toward head corner assembly 32. During assembly of the bed rail frame, the two sections of lower rod 22 are interconnected, as shown in FIG. 10. Then, as shown in FIG. 9, the end of the rod 22 having a v-shaped groove 41 is inserted into keyed receiver 39 so that the groove 41 is in alignment with corresponding v-shaped key 42. The other end of rod 22 is provided with a resiliently biased coupler 43. A spring-loaded button 44 adjacent the coupler 43 is depressed, and the coupler is slightly withdrawn axially to cover the button (See, FIG. 3). The end of the rod 22 is swung into axial alignment with the grooved shaft 38, and the coupler 43 is then extended axially to engage the shaft 38. When button 44 emerges into cutout 46, it pops up and prevents disengagement between the coupler and the shaft.

Bed rail covering 13 is made from a flexible material, such as plastic, vinyl or fabric. Bed rail covering 13 is generally rectangular in configuration, and is substantially co-extensive with side panel frame 21. Bed rail covering 13 includes internal sleeves which are sized and configured to accommodate and substantially cover the lower rod 22 and the upper rod 23 and the first and second vertical shafts 26 and 27. During the assembly of the rods 22 and 23 with the first and second vertical shafts 26 and 27, these components are passed through these sleeves and connected together in the manner described above. This forms the side panel frame 21 within the covering 13, providing a side panel for the bed rail 11 which is rigid around its periphery but resilient and compliant in the region between the rods 22 and 23.

A rectangular insert 47, made from a foraminous netting material, is also provided in the region between the rods 22 and 23. Insert 47 allows the patient or child to see through the side panel, and also provides some degree of safety against suffocation by someone whose face rests against it. However, the resiliency and compliancy of this substantially unsupported material allows the insert to be pushed outwardly and perhaps stretched to form a pocket into which a patient or child could become entrapped. To prevent such an occurrence, intermediate rod 24 is provided. After preassembling its two sections, rod 24 it is inserted into an open end 48 of a sheath 49. The other end of sheath 49 is closed. With rod 24 fully installed in its sheath, closure flap 51 is wrapped over the end of rod 24, and secured in place by means of hook and loop pieces 52 and 53. Rod 24 thereby provides an imbedded rigid structure within the side panel, effective to resist outward lateral forces imposed by a disabled person or a child.

Preferably, rod 24 is slightly longer than the distance between vertical shafts 26 and 27. Thus, when forces are applied against rod 24, those forces will be applied through the ends of the rod against shafts 26 and 27. However, rod 24 may be manufactured so that its overall length is less than the distance between shafts 26 and 27, and the bed rail 11 of the present invention will still perform satisfactorily.

Figure 12:
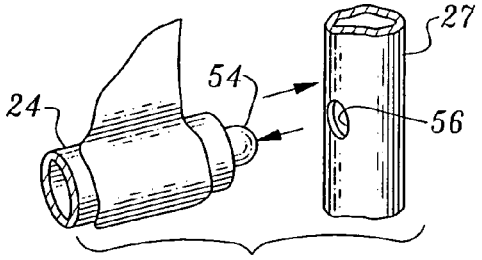
FIG. 12 is a first alternative method of attaching the intermediate rod to the vertical shafts; and, FIG. 13 is a second alternative method of attaching the intermediate rod to the vertical shafts.
Figure 13:
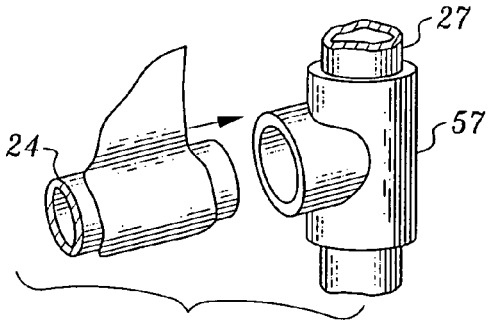

Owing to the structural integration of rod 24 with bed rail covering 13, no direct physical interconnection between rod 24 and first vertical shaft 26 and second vertical shaft 27 needs to be made. However, for a first alternative construction, shown in FIG. 12, intermediate rod 24 is provided with an end pin 54 and shaft 27 includes an aperture 56. Corresponding structure is provided on the other end of rod 24 and on shaft 26. Additionally, the sheath accommodating rod 24 will be open at both ends, so that pin 54 may be inserted in aperture 56 to provide a direct physical connection between rod 24 and the remainder of side panel frame 21. And, a second alternative construction is shown in FIG. 13. In this arrangement, a "T" coupling 57 is provided on shaft 27. The open end of rod 24 is simply inserted into the open side of the coupling 57. Again, corresponding structure on shaft 26 will accommodate the other end of rod 24.

To assure that bed rail 11 will not shift or otherwise disengage from the bed, a y-shaped anchor strap 58 is provided. Strap 58 has a first side 59 connected to head corner assembly 32, and a second side 61 connected to foot corner assembly 33. Strap 58 also includes a leg 62 which extends across to the other side of the bed. Leg 62 terminates in anchor plate 63. Adjustment means (not shown) allows strap 58 to be pulled taught against anchor plate 63, securing bed rail 11 in place.

It will be appreciated, then, that I have disclosed herein a bed rail construction with an entrapment-resistant side panel, having an imbedded rigid structure in the bed rail covering which effectively resists outward lateral forces imposed by a disabled person or a child.

What is claimed is:

1. A bed rail comprising:

a. a bed rail frame including bed rail legs adapted to fit between a bed box spring and a bed mattress, each of said rail legs having an outer end extending to one side of the bed, said bed rail frame further including an elongated side panel frame having a horizontal axis, said side panel frame extending vertically above said bed mattress and comprised of a lower rod, an upper rod, and an intermediate rod between said lower and upper rods, said lower and upper rods having end extremities interconnected to a first vertical shaft and a second vertical shaft extending from said outer ends of said rail legs; and, b. a flexible bed rail covering, said bed rail covering being substantially co-extensive with said side panel frame and including sleeves sized and configured to accommodate and substantially cover said lower rod, said upper rod, and said first and second vertical shafts, said bed rail covering further including an intermediate sheath to accommodate said intermediate rod, said intermediate sheath extending substantially between said first and second vertical shafts and having closure means at each end thereof to restrain said intermediate rod from longitudinal movement.

2. A bed rail as in claim 1 in which said closure means comprises a hook and loop fastener.

3. A bed rail as in claim 1 in which said lower, intermediate and upper rods are each comprised of two rod sections, each being detachably interconnected at respective adjacent ends to form a single rod.

4. A bed rail as in claim 1 including a head corner assembly and a foot corner assembly, said corner assemblies interconnecting said side panel frame with said bed rail legs.

5. A bed rail as in claim 4 further including an anchor strap, said anchor strap comprised of a head strap and a foot strap, said head strap having one end connected to said head corner assembly and said foot strap having one end connected to said foot corner assembly, said head strap and said foot strap extending between and across said bed box spring and bed mattress to join and terminate in an anchor plate, said anchor plate having an upper portion extending over said bed mattress and a lower portion extending over said bed box spring.

6. A bed rail as in claim 1 in which said bed rail covering is plastic, vinyl or fabric.

7. In a bed rail having a bed rail frame including bed rail legs adapted to fit between a bed box spring and a bed mattress, each of said rail legs having an outer end extending to one side of the bed, said bed rail frame further including an elongated side panel frame having a horizontal axis, said side panel frame extending vertically above said bed mattress and comprised of a lower rod and an upper rod, said lower and upper rods having end extremities interconnected to a first vertical shaft and a second vertical shaft extending from said outer ends of said rail legs, a flexible bed rail covering, said bed rail covering being substantially co-extensive with said side panel frame and including sleeves sized and configured to accommodate and substantially cover said lower rod, said upper rod, and said first and second vertical shafts, the improvement comprising: an intermediate rod between said lower and upper rods, extending substantially between said first vertical shaft and said second vertical shaft, said intermediate rod being attached to said bed rail covering by an intermediate sheath extending substantially between said first and second vertical shafts and having closure means at each end thereof to restrain said intermediate rod from longitudinal movement, said intermediate rod being located so as to restrain outward lateral excursions of said bed rail covering in the region between said lower and upper rods.

8. A bed rail comprising:

a. a bed rail frame including a head corner assembly and a foot corner assembly, each of said corner assemblies having a bed foot extending horizontally therefrom which is adapted to fit between a bed box frame and a bed mattress, each of said corner assemblies having a shaft extending vertically therefrom, said bed rail frame further including a lower rod and an upper rod, arranged in spaced relation and extending between said shafts;

b. a flexible bed rail covering, said bed rail covering extending horizontally between said shafts and vertically between said lower rod and said upper rod, said bed rail covering further including sleeves sized and configured to accommodate and substantially cover said lower rod, said upper rod, and said first and second vertical shafts; and, c. an intermediate rod between said lower and upper rods, said intermediate rod being attached to said bed rail covering by an intermediate sheath having closure means at each end thereof to restrain said intermediate rod from longitudinal movement and located so as to restrain outward lateral excursions of said bed rail covering in the region between said lower and upper rods.

9. A bed rail as in claim 8 in which said intermediate rod is attached to said bed rail covering by an intermediate sheath having closure means at each end thereof to restrain said intermediate rod from longitudinal movement.

10. A bed rail as in claim 8 in which said closure means comprises a hook and loop fastener.

11. A bed rail as in claim 8 in which said lower, intermediate and upper rods are each comprised of two rod sections, each being detachably interconnected at respective adjacent ends to form a single rod.

12. A bed rail as in claim 8 further including an anchor strap, said anchor strap comprised of a head strap and a foot strap, said head strap having one end connected to said head corner assembly and said foot strap having one end connected to said foot corner assembly, said head strap and said foot strap extending between and across said bed box spring and bed mattress to join and terminate in an anchor plate, said anchor plate having an upper portion extending over said bed mattress and a lower portion extending over said bed box spring.

13. A bed rail as in claim 8 in which said bed rail covering is plastic, vinyl or fabric.

14. A bed rail comprising:

a. a bed rail frame including a head corner assembly and a foot corner assembly, each of said corner assemblies having a bed foot extending horizontally therefrom which is adapted to fit between a bed box frame and a bed mattress, each of said corner assemblies having a shaft extending vertically therefrom, said bed rail frame further including a lower rod and an upper rod, arranged in spaced relation and extending between said shafts;

b. a flexible bed rail covering, said bed rail covering extending horizontally between said shafts and vertically between said lower rod and said upper rod, said bed rail covering further including sleeves sized and configured to accommodate and substantially cover said lower rod, said upper rod, and said first and second vertical shafts; and, c. restraint means attached to said bed rail covering and located between said lower and upper rods, said restraint means being sufficiently rigid so as to restrain outward lateral excursions of said bed rail covering in the region between said lower and upper rods, said restraint means comprising an intermediate rod extending substantially between said shafts and being attached to said bed rail covering by an intermediate sheath having closure means at each end thereof to restrain said intermediate rod from longitudinal movement.

15. A bed rail as in claim 14 in which said closure means comprises a hook and loop fastener.

16. A bed rail as in claim 14 in which said lower, intermediate and upper rods are each comprised of two rod sections, each being detachably interconnected at respective adjacent ends to form a single rod.

17. A bed rail as in claim 14 further including an anchor strap, said anchor strap comprised of a head strap and a foot strap, said head strap having one end connected to said head corner assembly and said foot strap having one end connected to said foot corner assembly, said head strap and said foot strap extending between and across said bed box spring and bed mattress to join and terminate in an anchor plate, said anchor plate having an upper portion extending over said bed mattress and a lower portion extending over said bed box spring.

18. A bed rail as in claim 14 in which said bed rail covering is plastic, vinyl or fabric.

* * * * *